United States Patent [19]

Tüρρζδδ

[11] 4,399,995

[45] Aug. 23, 1983

[54] CHESS GAME AUTOMATIC CONTINUATION CIRCUIT

[76] Inventor: Dieter Tünnerhoff, Walramstrasse 29, 5750 Menden, Fed. Rep. of Germany

[21] Appl. No.: 273,388

[22] Filed: Jun. 15, 1981

[30] Foreign Application Priority Data

Jun. 14, 1980 [DE] Fed. Rep. of Germany ..... 3022405

[51] Int. Cl.[3] ..... A63F 3/02

[52] U.S. Cl. ..... 273/237; 273/238

[58] Field of Search ..... 273/1 E, 1 ES, 148 R, 273/237, 238, 54 C; 235/92 GA, 375; 364/410–412, 200 MS File, 900 MS File; 340/323 R, 323 B; 346/146

[56] References Cited

U.S. PATENT DOCUMENTS

| | | | |
|---|---|---|---|
| 3,843,132 | 10/1974 | Ferguson | 273/238 |
| 4,234,933 | 11/1980 | Adelson et al. | 364/900 |
| 4,235,442 | 11/1980 | Nelson | 273/237 |
| 4,237,541 | 12/1980 | Mikada | 364/710 |

FOREIGN PATENT DOCUMENTS

| | | | |
|---|---|---|---|
| 52-46951 | 4/1977 | Japan | 273/238 |

*Primary Examiner*—Vance Y. Hum

*Attorney, Agent, or Firm*—Schwartz, Jeffery, Schwaab, Mack, Blumenthal & Koch

[57] ABSTRACT

A data processing unit for chess with a central unit, with input keys for the central unit and with a start key for the initiation of the program for the calculation of a subsequent move of the game, and with a printing unit, comprising a control unit, a storage device, a power stage and a printer, the central unit being connected via a data collecting cable to the printing unit. The problem of the invention is the automatic continuation of the course of the game with any desired default time. For this purpose, a switching stage which responds to the print command transmitted in the data collecting cable is provided for. A relay is up-circuit from this switching stage, the normally-open contact of this relay being connected to the central unit, in parallel with the start key.

2 Claims, 1 Drawing Figure

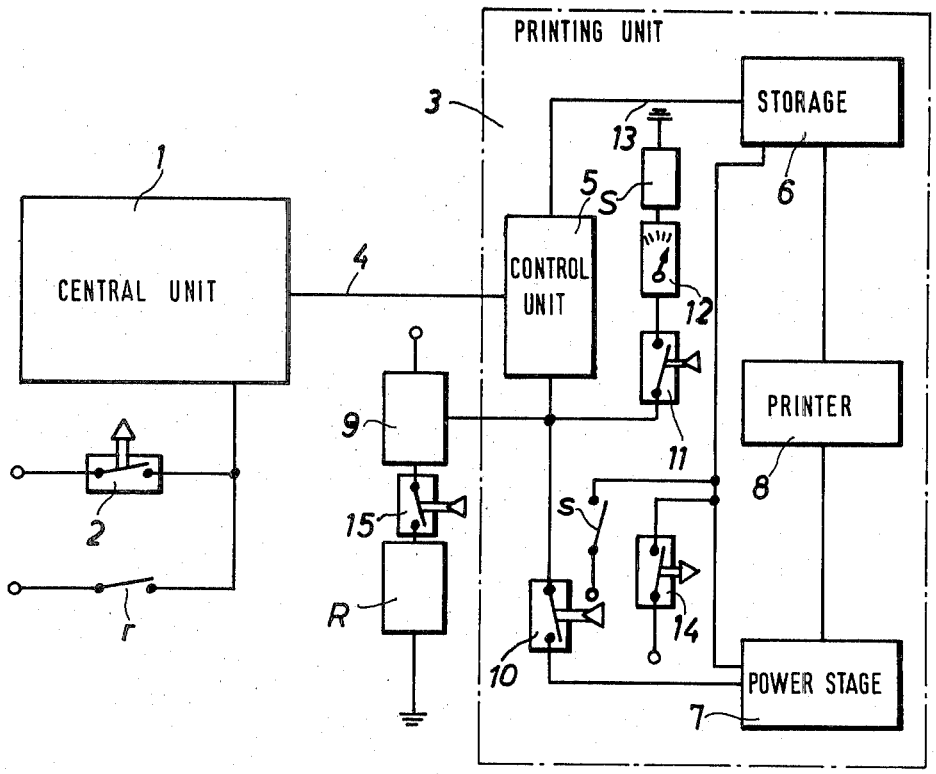
PRINTING UNIT
STORAGE
CENTRAL UNIT
CONTROL UNIT
PRINTER
POWER STAGE
1
2
3
4
5
6
7
8
9
10
11
12
13
14
15
R
r
S
s

CHESS GAME AUTOMATIC CONTINUATION CIRCUIT

BACKGROUND OF THE INVENTION

1. Field of the Invention

The invention relates to a data processing unit for chess with a central unit, with input keys for the central unit and with a start key for initiating the program for the calculation of a subsequent move of the game, and with a printing unit, comprising a control unit, a storage device, a power stage and a printer, the central unit being connected to the printing unit via a data collecting cable.

2. Description of the Prior Art

A data processing unit for chess comprises a central unit which checks and evaluates possible moves of the game each time the start key is released, so that, of the multitude of possible moves, the move most suitable for strengthening the state of the game is selected. This enquiry and evaluation requires considerable time, even with the high pulse time of a data processing unit. The strength of the data processing unit for chess is greater, the greater the default time. Data processing units for chess allow default times of up to 100 hours and more.

If such great default times are chosen, the data processing unit for chess has a high playing strength. This means, however, that each time the default time has elapsed, a further move must be input or the data processing unit for chess is activated by renewed operation of the start key to determine the next move for the particular opposing colour. It is very tedious for the user of this type of data processing unit for chess to adjust each time to the elapse of the default time and to initiate the next move of the game.

SUMMARY OF THE INVENTION

The object of the invention is an improvement of a data processing unit for chess, such that, with any desired default time, an expedient and automatic continuation of the course of the game is possible.

This object is achieved according to the invention by providing a switching stage which responds to the print command transmitted in the data collecting cable, and by having a relay up-circuit from this switching stage, the normally-open contact on the relay being connected to the central unit, in parallel with the start key.

The print command transmitted each time after calculation of a move of the game is thus used to initiate the next particular calculation. The continuing calculation of the course of the game is hence possible, without the user having to input or to initiate the particular subsequent move. This means that the performance capability of a data processing unit for chess can be utilized to the full extent, even on utilising the full playing strength by means of a high default time.

The following is provided for in a further improvement of the invention: a cut-out switch is provided before the entrance of the power stage of the printing unit and data cables from the control unit run directly to the storage device. In this way, the switching-on of printing unit each time is suppressed, since, normally, the printing of every move is not required. The move is, however, kept in the storage device.

The following is provided for in a further improvement of the invention: a further switch is connected to the control unit of the printing unit, and this switch, in the switched-on state, allows the print command to pass to the storage device and the power stage in such a way that the state of play is printed out.

The various moves are hence retained in the storage device of the printing unit. This storage device is called after every move, so that the complete state of the game is printed out.

Since it is not necessary to examine the complete state of the game after every move, the invention further provides for an adjustable scaler which is up-circuit from the switch mentioned. This improvement of the invention makes it possible to print out the state of play after every few moves.

BRIEF DESCRIPTION OF THE DRAWING

An embodiment of the invention is illustrated in the following text with reference to the accompanying drawing, which represents a block diagram of a data processing unit for chess.

DESCRIPTION OF THE PREFERRED EMBODIMENT

The data processing unit for chess comprises a central unit 1, which comprises, in a customary manner, an arithmetic unit, a control unit, a storage device and other necessary construction elements. Data and commands, hence information about the state of play and the arithmetic operations to be carried out, can be input via input keys, which are not represented in the drawing in detail. A start key 2 is present in the input keyboard, and this key initiates the program for the calculation of a subsequent move of the game, so that the central unit 1 calculates the particular subsequent move of the game. It is possible to introduce a default time for the calculation of the move of the game via a group of keys of the input keyboard which are not represented in the drawing. The time can be given up to 100 hours or more in advance. Peripheral units can be connected to the central unit 1. Within the scope of the invention, reference is made to the printing unit 3. The central unit 1 is connected via a data collecting cable 4 to the printing unit. The printing unit comprises a control unit 5, a storage device 6, a power stage 7 and a printer 8. This printer 8 is activated via the power stage 7.

As soon as the central unit 1 has transmitted the particular subsequent move of the game, according to the default time, the appropriate information is transmitted via the data collecting cable 4 to the control unit 5 of the printing unit 3. A print command contained in this information block activates the power stage 7, so that the printer 8 is switched to a ready-condition in order to print out the coordinates of the particular calculated move of the game. Within the printing unit, a storage device 6 is present, which stores the particular data and holds the printer appropriately in readiness. The storage device 6 stores the individual moves of the game as well as the total state of the game. The state of the game may be called up via a particular key 14. The storage device 6 is connected, via a data cable 13, directly to the control unit 5, so that even when the power stage 7 is switched off, the moves of the game can be retained in the storage device 6.

The program of the central unit is terminated on transmission of the information block for a move of the game on the data collecting cable 4 to the printing unit 3. The particular subsequent move of the game can then be input via the input keyboard. By releasing the start key 2, the data processing unit for chess can also be induced to calculate the next particular move of the game for the opposing colour of play. After elapse of the default time and with print-out of the particular move of the game, the user of the data processing unit for chess must, normally, input information via the input keyboard into the central unit. This is troublesome in the calculation of extensive and difficult chess problems, since the user does not know from the outset when the particular move of the game has been calculated, and since, in addition, the long default times can elapse at inconvenient times of the day.

For this reason, the invention provides for a switch 15 and an additional switching stage 9, which responds to the print command and which is coupled in an appropriate manner to the control unit 5. If the switch 9 is in the "on" position, the print command can activate the switching stage 9. The switching stage 9 is up-circuit from a relay R, the normally-open contact r of which, in parallel with start key 2, is directed to the corresponding entrance of the central unit 1. Consequently, the print command causes on the one hand the activation of the printing unit to print-out the state of the game, and gives, on the other hand, via the switching stage 9 and the relay contact r, a command or a signal to the central unit, so that, in this unit, the program for the calculation of the next particular move of the game for the opposing colour of play is initiated. The data processing unit for chess thus calculates, in uninterrupted sequence, in each case after elapse of the default time, the next move of play for the opposing colour of play, so the user of the data processing unit for chess does not need to monitor the elapse of the default time. Moreover, the data processing unit for chess can be used for the calculation of extensive and complicated problems and, for example, can function over long periods of weeks, without intermediate intervention of the user being necessary.

In a further improvement of the invention, a cut-out switch 10 in the route for the print command is provided for, so that activation of the power stage can be stopped if this cut-out switch 10 is in the off position. In this way, the print-out of every move of the game is suppressed. Rather, the state of the game calculated in the central unit 1 is transmitted from the control unit 5 via the data cable 13 directly to the storage device 6, where it is recorded. The state of the game can be called-up as desired.

The invention further provides for a switch 11 which allows the print command to pass, in each case, to the storage device 6. In the switched-on state of switch 11, a relay S is activated, in each case after the occurrence of a print command, thus in each case after the calculation of a move of the game, in such a way that the relay contact s is closed. This relay contact s is parallel to the key 14, so that the relay contact s induces the print-out of the complete state of the game.

Since a print-out of the state of the game is not necessary after every move of the game, the invention further provides for a scaler 12, which is up-circuit from the switch 11. This scaler 12 is adjustable over a varying reduction ratio. By means of this scaler 12, not every print command is allowed through to the relay S, but a suppression is effected according to the reduction set. Thus, for example, only every 4th print command is allowed through to the relay S, so that in each case only after four moves of the game is a complete print-out of the state of the game induced, by activation of the relay contact s.

The invention thus makes possible a considerable extension of the usefulness and the suitability of a data processing unit for chess.

I claim:

1. Apparatus for selectively enabling fully automatic play of a chess game including a data processing unit having a start input terminal and operable to automatically calculate chess moves and generating a print command signal as a result thereof, a manually operable start switch connected to said start input terminal for producing an activation signal to said data processing unit for initiating said calculations corresponding to only one move, a memory storage device for storing each calculated move and a printer unit responsive to said print command signals for printing coordinates of each calculated move, comprising: a switching device having a first portion responsive to said print command signal and a second portion connected to said start input terminal of said data processing unit for generating an additional activation signal to said start input terminal in response to each of said print command signals whereby each print command signal activates said data processing unit to calculate an additional chess move.

2. Apparatus for selectively enabling fully automatic play of a chess game having a data processing unit operable to automatically calculate chess moves and generating a print command signal as a result thereof, a manually operable start switch operable for activating said processing unit for initiating calculations corresponding to only one move, a memory storage device for storing each calculated move and a printer unit responsive to said print command signals for printing coordinates of each calculated move, comprising:

(a) a first switch connected in parallel with said start switch, (b) a relay responsive to said print command signal for activating said first switch for simulating to said data processing unit activation of said start switch, whereby said data processing unit calculates another chess move, and (c) a second switch connected in series with said relay and manually operable for selecting said fully automatic play of said chess game, whereby, upon operation of said second switch, each print command signal activates said data processing unit to calculate an additional chess move.

* * * * *